United States Patent [19]

Rohner et al.

[11] 4,322,943

[45] Apr. 6, 1982

[54] DEVICE FOR JOINING AN UPPER THREAD TO A LOWER THREAD

[75] Inventors: Joachim Rohner; Heinz Zumfeld, both of Monchen-Gladbach, Fed. Rep. of Germany

[73] Assignee: W. Schlafhorst & Co., Monchen-Gladbach, Fed. Rep. of Germany

[21] Appl. No.: 225,635

[22] Filed: Jan. 16, 1981

[30] Foreign Application Priority Data

Jan. 19, 1980 [DE] Fed. Rep. of Germany ..... 3001918

[51] Int. Cl.[3] ..... D01H 15/00

[52] U.S. Cl. ..... 57/261; 57/22

[58] Field of Search ..... 57/22, 23, 261

[56] References Cited

U.S. PATENT DOCUMENTS

| | | | |
|---|---|---|---|
| 4,217,749 | 8/1980 | Rohner et al. | 57/261 |
| 4,232,509 | 11/1980 | Rohner et al. | 57/261 |
| 4,240,247 | 12/1980 | Matsui et al. | 57/22 X |
| 4,246,744 | 1/1981 | Matsui et al. | 57/261 X |

*Primary Examiner*—Donald Watkins

*Attorney, Agent, or Firm*—Herbert L. Lerner; Laurence A. Greenberg

[57] ABSTRACT

Device for joining an upper thread to a lower thread by splicing, including a splicing chamber for inserting and joining the threads, a compressed air canal ending inside the splicing chamber, a thread feeder being movable from a thread receiving position to a thread surrender position for inserting the threads into the splicing chamber, thread cutting means for cutting off ends of the upper and lower threads to produce shortened thread ends, a controllable and adjustable compressed air dosing valve being connected to the compressed air canal, first pneumatic means disposed above the splicing chamber for receiving the shortened thread end of the lower thread, second pneumatic means disposed below the splicing chamber for receiving the shortened thread end of the upper thread, and suction nozzles disposed on the pneumatic means having screen-like perforated surfaces, the thread cutting means, dosing valve and pneumatic means being controllable as a function of the position of the thread feeder.

8 Claims, 5 Drawing Figures

DEVICE FOR JOINING AN UPPER THREAD TO A LOWER THREAD

The invention relates to a device for joining an upper thread to a lower thread by splicing, including a splicing chamber with, if applicable, a coverable longitudinal slot for the insertion and joining of the threads, a compressed-air canal ending inside the splicing chamber, a thread feeder which is movable from a thread receiving position to a thread surrendering position for the insertion of the threads into the longitudinal slot of the splicing chamber, and with the following components, being controllable as a function of the position of the thread feeder:

(a) if applicable, a cover to close the splicing chamber temporarily, (b) thread cutting devices to cut off the ends of the upper and lower threads, (c) a controllable and adjustable compressed air dosing valve, (d) a pneumatic device disposed above the splicing chamber to receive the shortened thread end of the lower thread, and (e) a pneumatic device disposed below the splicing chamber to receive the shortened thread end of the upper thread.

Heretofore, the thread ends were held in such devices by mechanical means, with thread ends of different lengths and threads differently looped leading to different thread tensions at the thread guiding points during the splicing operation. Otherwise the thread ends were left to themselves after having been cut, which means that they could shift, resulting in uneven joints or faulty splices. This, in turn, impaired the quality of the spliced connection. To improve the spliced connection, it has already been proposed in U.S. patent application Ser. No. 205,280 dated Nov. 10, 1980, to suck-in and retain each shorter thread end newly produced after the cut-off by means of an air stream.

The pneumatic devices proposed for this purpose receive the thread ends within them, whereby the thread ends can become stretched and untwined or unwound more than necessary.

It is accordingly an object of the invention to provide a device for joining an upper thread to a lower thread which overcomes the hereinafore-mentioned disadvantages of the heretofore-known devices of this general type, and to improve the quality of the spliced connection and the reliability of the splicing operation even further, in particular to also improve the strength and appearance of the spliced connection and to extend the application of thread splicing to threads of greater fineness.

With the foregoing and other objects in view there is provided, in accordance with the invention, a device for joining an upper thread to a lower thread by splicing, comprising a splicing chamber for inserting and joining the threads, a compressed air canal ending inside the splicing chamber, a thread feeder being movable from a thread receiving position to a thread surrender position for inserting the threads into the splicing chamber, thread cutting means for cutting off ends of the upper and lower threads to produce shortened thread ends, a controllable and adjustable compressed air dosing valve being connected to the compressed air canal, first pneumatic means disposed above the splicing chamber for receiving the shortened thread end of the lower thread, second pneumatic means disposed below the splicing chamber for receiving the shortened thread end of the upper thread, and suction nozzles disposed on the pneumatic means having screen-like perforated surfaces, the thread cutting means, dosing valve and pneumatic means being controllable as a function of the position of the thread feeder.

In accordance with another feature of the invention, the splicing chamber has a surface with a longitudinal slot formed therein for receiving the threads, and there is provided a cover for temporarily closing the splicing chamber, the cover being controllable as a function of the position of the thread feeder.

In accordance with a further feature of the invention, the suction nozzles are integral with the splicing chamber and the screen-like perforated surfaces are integral with the surface of the splicing chamber at the longitudinal slot.

In accordance with an added feature of the invention, the screen-like perforated surfaces are in the form of grids.

In accordance with an additional feature of the invention, the screen-like perforated surfaces are in the form of walls having openings formed therein.

In accordance with again another feature of the invention, the thread feeder includes an upper feeder element disposed above the splicing chamber and a lower feeder element disposed below the splicing chamber.

In accordance with again a further feature of the invention, the thread cutting means are in the form of first controllable cut-off means for the lower thread and second controllable cut-off means for the upper thread and there are provided first controllable clamping means for the upper thread and second controllable clamping means for the lower thread, the first cut-off means and clamping means being disposed above the upper feeder element, and the second cut-off means and clamping means being disposed below the lower feeder element.

In accordance with a concomitant feature of the invention, the first pneumatic means for the lower thread is disposed above the upper thread feed element and below the first cut-off means for the lower thread, and the second pneumatic means for the upper thread is disposed below the lower thread feeder element and above the second cut-off means for the upper thread.

The advantages achieved by the invention are, in particular, that the quality of the spliced connection is improved by the provision that the thread ends, after being shortened first, are resiliently retained with moderate force without stretching or untwining so that further thread length can be passed into the splicing chamber which, overall, leads to a better spliced connection. Strength and appearance of the spliced connection have also been improved.

The thread ends are treated gently and yet can stay extremely short, if the proposed suction nozzles form part of the splicing chamber itself. Also, the unique configuration of the feeder elements, clamping devices or cut-off devices supports the formation of a good spliced connection in an advantageous manner.

The quality of the spliced connection is improved with regard to the processability of the thread and the appearance of the thread connection. Due to the gentle treatment of the thread ends, thinner threads than heretofore can be spliced together.

The device for joining the upper thread to the lower thread may advantageously be a device moving from work station to work station.

Other features which are considered as characteristic for the invention are set forth in the appended claims.

Although the invention is illustrated and described herein as embodied in a device for joining an upper thread to a lower thread, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
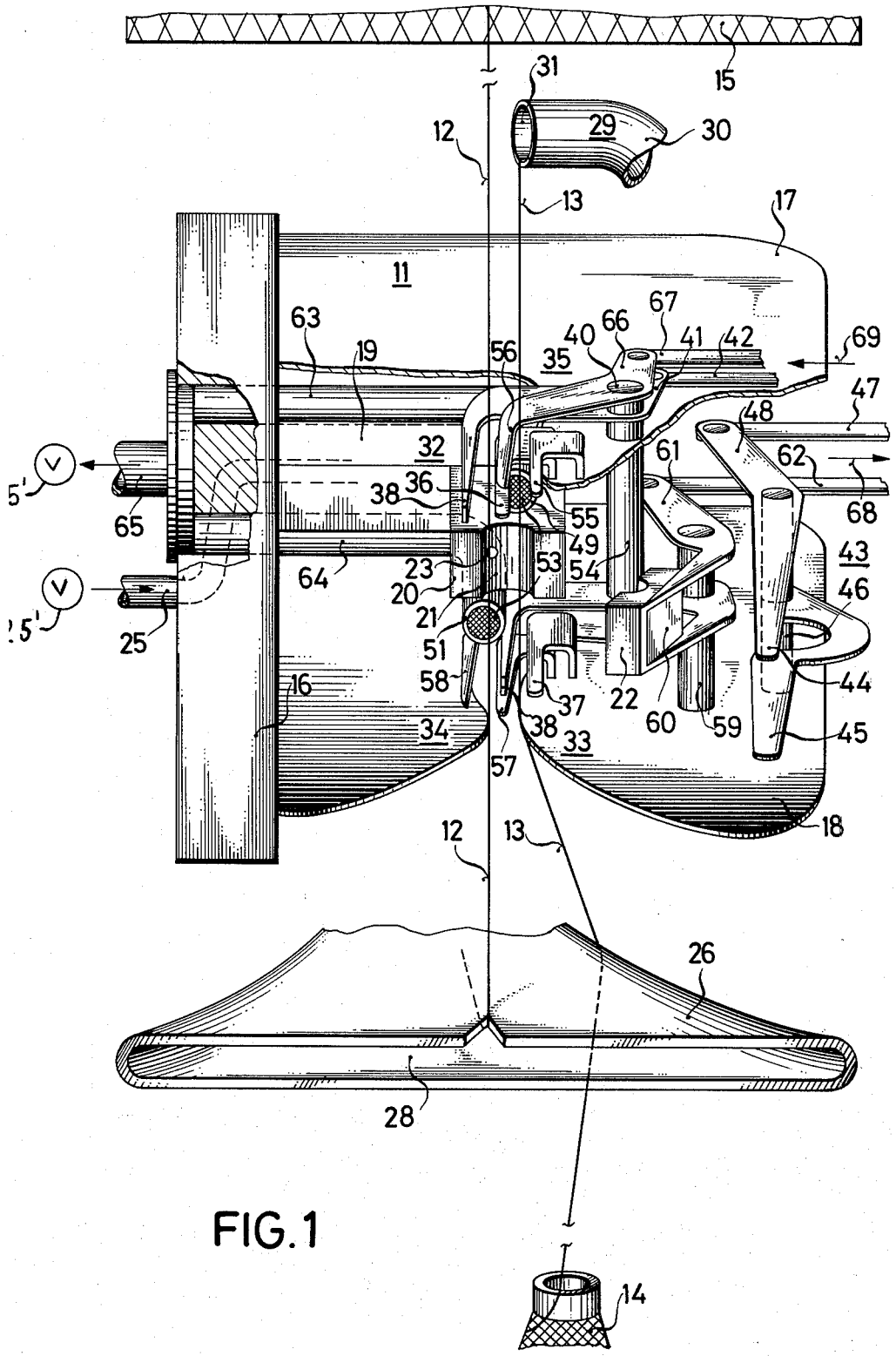
FIG. 1 is a fragmentary diagrammatic perspective view, partly broken away, of the device according to the invention with the splicing chamber open.
Figure 2:
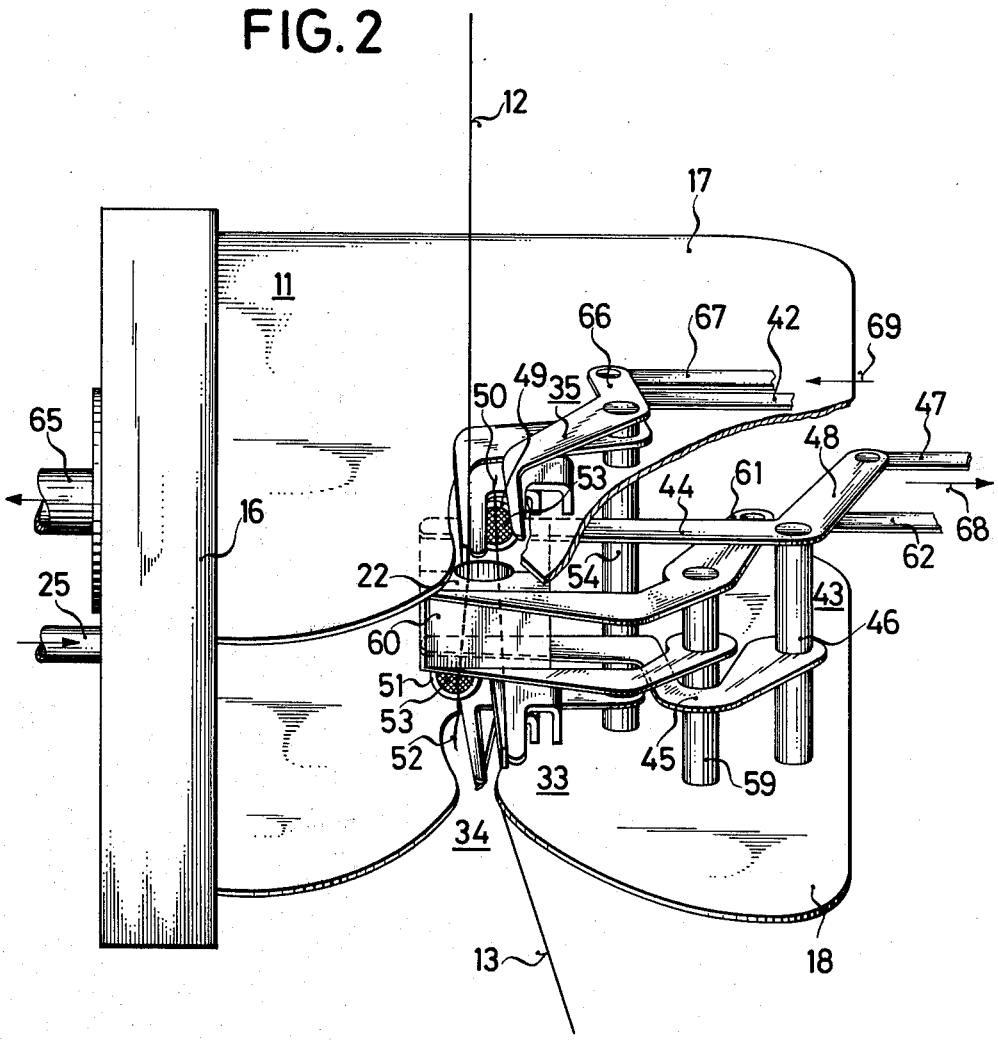
FIG. 2 is a diagrammatic perspective view of the device according to the invention with the splicing chamber closed.
Figure 3:
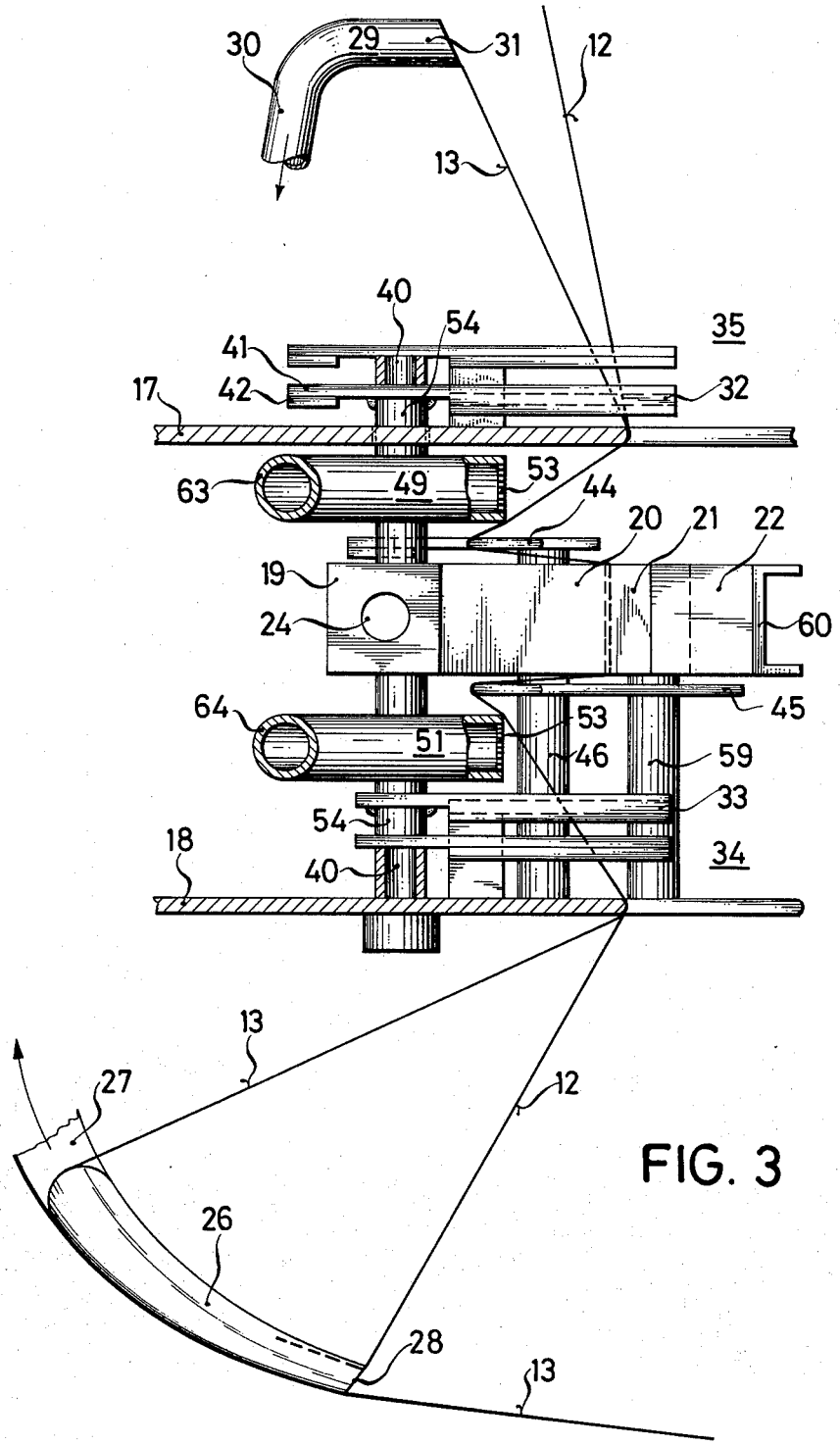
FIG. 3 is a fragmentary diagrammatic simplified side elevational view of the device.

Referring now to the figures of the invention and first particularly to FIGS. 1–3 thereof, there is seen a device designated with reference numeral 11 in its entirety, for joining an upper thread 12 to a lower thread 13. As described in U.S. patent application Ser. No. 205,280, filed Nov. 10, 1980, the device 11 has a machine frame 15 which supports a carriage. The carriage has trolley wheels, by means of which the device 11 is movable on a tubular support along a textile machine, e.g. a winding machine.

It is assumed that the device 11 happens to be operative at a winding station. At the winding station, the lower thread 13 arrives at the device 11 from an unwinding spool 14. The upper thread 13 also arrives at the device 11 from a winding spool 15.

The device 11 has two plates 17, 18, fastened to the machine frame 16. A splicing chamber 20 is attached to an arm 19 of the machine frame 16. The splicing chamber 20 has a longitudinal slot 21 formed therein which can be closed by a cover 22. When the cover is open, the threads can be inserted in the longitudinal slot of the splicing chamber. The rims of the mouths of the longitudinal slot 21 are rounded. A compressed-air canal 23 ends in the interior of the splicing chamber 20 formed by the longitudinal slot 21 and the cover 22. The compressed air canal 23 communicates with a compressed-air canal 24 in the arm 19 shown in FIG. 3, which continues as a tubular line 25 leading to a compressed-air dosing valve 25'.

A thread grab 26 is equipped with means to search for and retain the thread end of the upper thread 12 on the take-up spool 15. These means include an arm 27 shown in FIG. 3 which is hollow inside and is connected through a swivel joint to an underpressure source not shown in detail, and a slit-type suction nozzle 28. FIGS. 1 and 3 show the thread grab 26 in thread surrender position.

A pivoted grab 29 is equipped with means to search for and retain the thread end of the lower thread 13. These means include a bent tube 30 which can be swiveled in a swivel joint and has a suction nozzle 31 which can be closed through spring force by a non-illustrated clip cover, as application Ser. No. 205,280 shows. The grab 29 is also shown in thread surrender position. To grab the thread end of the lower thread 13, the tube 30 swings down, grabs the lower thread 13 near the unwinding spool 14, attracts it by using the suction nozzle 31, swings back into the thread surrender position and retains the thread end as shown in FIGS. 1 and 3.

Also seen in the drawings are two controllable clamping devices 32, 33. The clamping device 32 for the upper thread is disposed above the splicing chamber 20 and also above the plate 17; the clamping device 33 for the lower thread is disposed below the splicing chamber 20 and above the plate 18. Each of the two clamping devices is of two-part construction. The clamping device 32 for the upper thread has a fixed clamping part 36 and a controllable clamp 38. The controllable clamp 38 is fastened to a hollow shaft 54 and has a lever 41 which can be controlled by means of a rod 42 and a cam plate that is not shown. The clamping device 33 for the lower thread has a fixed clamping part 37 and a controllable clamp 38 which is likewise connected to the hollow shaft 54. The hollow shaft 54 is mounted in the plates 17, 18. The clamping part 36 is attached to the plate 17 and the clamping part 37 to the plate 18.

The drawings show in addition a pivoted, two-armed thread feeder 43 including a bolt 46 with feeder elements 44, 45 fastened thereto. The bolt 46 is rotatably mounted in the plates 17 and 18. To pivot the thread feeder 43, a rod 47 is hinged to a lever 48 fastened to the feeder element 44.

The thread feeder 43 can be swung from the thread receiving position shown in FIG. 1 to the thread surrender position shown in FIG. 2. As shown in FIG. 2, disposed above the splicing chamber 20 is a pneumatic device 49 for receiving the shortened thread end 50 of the lower thread 13, and below the splicing chamber 20 a pneumatic device 51 is disposed for receiving the shortened thread end 52 of the upper thread 12. Each of the two pneumatic devices has a suction nozzle 53 provided with a surface perforated in the manner of a screen. The surface perforated in the manner of a screen is formed by a screenlike metal grid. As soon as the thread ends are attracted by the pneumatic devices, they cling to the screen-like perforated surface of the suction nozzle 53 without entering the suction nozzles.

Disposed above the upper feeder element 44 is a controllable cut-off device 35 for the lower thread 13, and below the lower feeder element 45 is a cut-off device 34 for the upper thread 12. Each cut-off device includes two blades interacting in scissor fashion. One blade of each device is fixed while the other blade is attached to a shaft 40 which is rotatably mounted in the hollow shaft 54. The blade 55 of the cut-off device 35, for instance, is fastened to the plate 17 while the blade 56 of the same cut-off device is pivoted. The blade 57 of the cut-off device 34 is connected to the plate 18 while the blade 58 of the same cut-off device is pivoted. A lever 66 that is joined to the blade 56, is hinged to a rod 67. The rod 67 is movable by a non-illustrated cam plate. A shaft 59 that is mounted in the plates 17, 18, supports a forked swivel arm 60, to which the cover 22 of the splicing chamber 20 is fastened. At the rear of the swivel arm 60 is a lever 61 which is linked to a rod 62.

It may be seen from FIGS. 1 and 2 that some components of the device 11 have special thread guiding contours. This is the case, for example, in the thread grab 26 and in the plates 17 and 18 so that the threads are inserted into the splicing chamber as shown in FIG. 1.

It may be seen from FIG. 3 that the pneumatic device 49 has a suction line 63 and the pneumatic device 51 has a suction line 64. Both suction lines end in a main 65 shown in FIGS. 1 and 2. The main 65 goes to a suction air dosing element 65' that is only diagrammatically shown.

By way of two embodiment examples it will now be explained with reference to the drawings how the device according to the invention functions.

To start with, it is assumed that the thread to be rewound has broken at the winding station in question. Thus an upper thread 12 and a lower thread 13 have been produced. The upper thread 12 has been absorbed by the take-up spool 15 and the lower thread 13 has been retained in the vicinity of the unwinding spool 14.

The thread rupture has been detected in a known manner and reported to the mobile joining device 11. The device 11 has traveled in front of the winding station. The thread feeder 43 is in the thread receiving position illustrated in FIG. 1. For the time being, the threads shown should be considered as nonexistent. Now the device 11 becomes active in the following manner:

Located in the device 11 is a non-detailed control mechanism equipped with cam plates. This mechanism starts upon a signal automatically initiated by the winding station and swings the thread grab 26 so that the slit-type suction nozzle 28 is close to the surface of the winding spool 15. Due to the underpressure acting on the slit-type suction nozzle 15, the thread end of the upper thread 12 is searched for, picked up by suction, and retained as the take-up spool is turning slowly or running out. At the same time, the control mechanism also rotates the bent tube 30 of the grab 29 until the underpressure acting on the suction nozzle 31 picks up and retains the thread end of the lower thread 13.

After a fixed, short action period the control mechanism turns the thread grab 26 and the grab 29 into their thread surrender positions shown in FIG. 1. The thread guiding contours of the plates 17 and 18 ensure that the upper thread 12 coming from the take-up spool 15 is inserted between the clamping part 36 and the clamp 38 of the clamping device 32 and in the longitudinal slot 21 of the splicing chamber 20. The lower thread 13, coming from the unwinding spool 14, is guided across the rear side of the thread grab 26 and between the clamping part 37 and the clamp 38 of the clamping device 33 and is likewise inserted in the longitudinal slot 21 of the splicing chamber 20.

Now the control mechanism, which is not shown in the drawing, actuates two cam plates, that are not shown either, which see to is that the rod 47 and the rod 62 are pulled out of their positions shown in FIG. 1 in the direction of arrow 68. During the motion of rod 47 the two feeder elements 44, 45 of the thread feeder 43 and the swivel arm 60 of the cover 22 swing to the left. The two cut-off devices 34 and 35 are still open. Shortly before the end position shown in FIG. 2 is reached, which is equivalent to the thread surrender position for the thread feeder 43, the cover 22 already contacts the edges of the longitudinal slot 21 of the splicing chamber 20. At the same time, due to the motion of rod 42 in the direction of the arrow 69 by means of the control mechanism, both clamping devices 32, 33 close while the cut-off devices 34 and 35 are actuated by the motion of rod 67 in the direction of the arrow 69 by means of the same control mechanism. An electric switching device that is not shown starts the air blast. During a blast period of, say, 2 seconds the newly made thread ends 50 and 52 are picked up and retained by the pneumatic devices 49 and 51. This also assures that more thread can be pulled if the splicing operation so requires.

From the end position shown in FIG. 2 the thread feeder 43 is returned into its basic position without delay after splicing; the cover 22, the cut-off devices 34, 35 and the clamping devices 32, 33 are opened; and the cam plates see to it that the rods 47 and 62 are moved back opposite to the direction of the arrow 68 and the rods 42 and 67 opposite to the direction of the arrow 69. The splicing time can be selectably set before or after the cut-off time.

The thread, joined by compressed air splicing at the end of the hereinafore-described operations, finally lies in the opened splicing chamber 20. Up to this time, the non-illustrated suction air dosing valve remains open.

When the winding station is subsequently put in operation again, the thread jumps out of the device 11 due to the winding tension that is setting-in again. The activity of the device 11 is now concluded; it can move to another action site. The thread is again outside of the range of travel of the device 11.

Figures 4, 5:
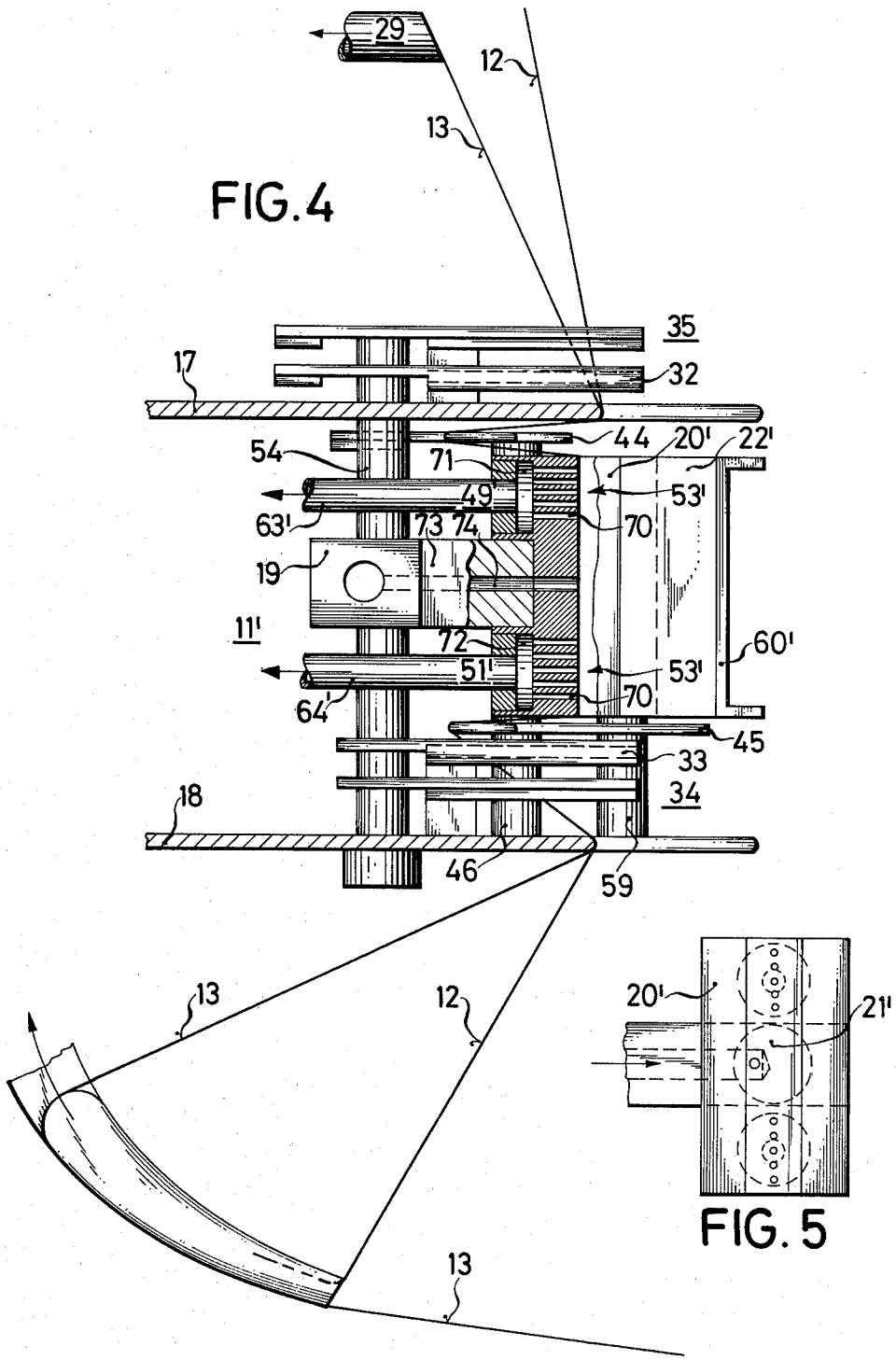
FIG. 4 is a simplified side elevational view similar to FIG. 3 of another embodiment example of the invention.
FIG. 5 is a fragmentary diagrammatic elevational view of the splicing chamber of the second embodiment example, constructed in accordance with the invention.

In the second embodiment example of the invention as shown in FIGS. 4 and 5, the suction nozzles 53' of the pneumatic devices 49', 51' form part of the splicing chamber 20'. The screen-like perforated surface of the suction nozzles simultaneously forms part of the surface of the longitudinal slot 21'. The screen-like perforated surface of the suction nozzles 53' is formed by a wall of the bottom of the longitudinal slot 21', provided with perforations 70. Each suction nozzle 53' has five mutually superposed openings 70 in the form of drilled holes ending in a main 71, 72, respectively. A suction line 63' goes from the main 71 of the pneumatic device 49', and a suction line 64' goes from the main 72 of the pneumatic device 51', to a suction air dosing element that is not shown.

The arm 19 supports an adapter 73 which has a hole 74 formed therein and to which the splicing chamber 20' is fastened. All other parts of the device for joining an upper thread to a lower thread designated with reference numeral 11' in its entirety, that are not specifically mentioned, correspond to those of the device 11 of the preceding embodiment example.

The invention is not restricted to the embodiment examples shown and described. Other embodiments are also possible within the scope of the claims.

The terms upper thread and lower thread are not bound to the terms "top" and "bottom". In this context, a thread coming from a thread supply point such as an unwinding spool or a thread generator is generally called a lower thread. The upper thread is the thread leading to a thread receiving point such as a take-up spool or winding arbor. The thread travel direction may be from the bottom to the top, as is the case in the embodiment example. However, the thread may also travel the other way, or may generally be directed arbitrarily in space, such as horizontally.

Although the embodiment example relates to a mobile device for joining threads, it goes without saying that a device according to the invention can also be disposed at each individual work station. In addition to winding machines, the device according to the invention is also applicable to spinning machines, creels, tufting machines and the like.

It has proved to be advantageous to close the splicing chamber during the splicing operation, but closing the splicing chamber is not absolutely necessary. Splicing can also be successful if the insertion slot and the air conductance are appropriately constructed and the insertion side of the splicing chamber stays open. However, the invention yields better results with a closed splicing chamber.

In another embodiment, the air stream required to retain the thread ends can also be generated by compressed air instead of suction air, for instance, by directing an air jet against the mouths of the thread suction nozzles.

The configuration of the plates, clamping devices and cut-off devices may also vary from that of the embodiment examples. For instance, it may be better for some threads to dispose the cut-off devices as close to the pneumatic devices as possible. The clamping devices may then be disposed next to them or behind them, i.e. reversed from that shown in the embodiment examples. At the same time, the upper plate could also be moved behind the upper cut-off device or clamping device, i.e. upward.

There is claimed:

1. Device for joining an upper thread to a lower thread by splicing, comprising a splicing chamber for inserting and joining the threads, a compressed air canal ending inside said splicing chamber, a thread feeder being movable from a thread receiving position to a thread surrender position for inserting the threads into said splicing chamber, thread cutting means for cutting off ends of the upper and lower threads to produce shortened thread ends, a controllable and adjustable compressed air dosing valve being connected to said compressed air canal, first pneumatic means disposed above said splicing chamber for receiving the shortened thread end of the lower thread, second pneumatic means disposed below said splicing chamber for receiving the shortened thread end of the upper thread, and suction nozzles disposed on said pneumatic means having screen-like perforated surfaces, said thread cutting means, dosing valve and pneumatic means being controllable as a function of the position of said thread feeder.

2. Device according to claim 1, wherein said splicing chamber has a surface with a longitudinal slot formed therein for receiving the threads, and including a cover for temporarily closing said splicing chamber, said cover being controllable as a function of the position of said thread feeder.

3. Device according to claim 2, wherein said suction nozzles are integral with said splicing chamber and said screen-like perforated surfaces are integral with said surface of said splicing chamber at said longitudinal slot.

4. Device according to claim 1, wherein said screen-like perforated surfaces are in the form of grids.

5. Device according to claim 1, wherein said screen-like perforated surfaces are in the form of walls having openings formed therein.

6. Device according to claim 1, 2, 4 or 5, wherein said thread feeder includes an upper feeder element disposed above said splicing chamber and a lower feeder element disposed below said splicing chamber.

7. Device according to claim 6, wherein said thread cutting means are in the form of first controllable cut-off means for the lower thread and second controllable cut-off means for the upper thread, and including first controllable clamping means for the upper thread and second controllable clamping means for the lower thread, said first cut-off means and clamping means being disposed above said upper feeder element, and said second cut-off means and clamping means being disposed below said lower feeder element.

8. Device according to claim 6, wherein said first pneumatic means for the lower thread is disposed above said upper thread feed element and below said first cut-off means for the lower thread, and said second pneumatic means for the upper thread is disposed below said lower thread feeder element and above said second cut-off means for the upper thread.

* * * * *